US008978663B2

(12) United States Patent
Newton

(10) Patent No.: US 8,978,663 B2
(45) Date of Patent: Mar. 17, 2015

(54) CHARGER PACKAGE FOR ELECTRONIC CIGARETTE COMPONENTS

(76) Inventor: Kyle D. Newton, North Richland Hill, TX (US)

( * ) Notice: Subject to any disclaimer, the term of this patent is extended or adjusted under 35 U.S.C. 154(b) by 629 days.

(21) Appl. No.: 12/960,940

(22) Filed: Dec. 6, 2010

(65) Prior Publication Data

US 2012/0227753 A1 Sep. 13, 2012

(51) Int. Cl.
*A24F 47/00* (2006.01)

(52) U.S. Cl.
CPC ..... *A24F 47/008* (2013.01)
USPC ..... 131/347; 223/92; 211/74; 211/19; 439/607.01

(58) Field of Classification Search
None
See application file for complete search history.

(56) References Cited

U.S. PATENT DOCUMENTS 2,667,293 A * 1/1954 Jacob ..... 223/92
3,142,385 A * 7/1964 Kahlenberg ..... 211/74

FOREIGN PATENT DOCUMENTS

KR 2009008914 * 9/2009

OTHER PUBLICATIONS http://www.blucigs.com/accessories/pack.html, Electroniics cigaratte pack and charger, Date: 2011.

* cited by examiner

*Primary Examiner* — Richard Crispino
*Assistant Examiner* — Phu Nguyen
(74) *Attorney, Agent, or Firm* — Dan Brown Law Office; Daniel R. Brown

(57) ABSTRACT

A charger package apparatus for use with electronic cigarette components, which include truncated components and elongated components that have an electrical coupling connected to a rechargeable power source. The apparatus includes a compact box enclosure with an access opening, and with plural compartments formed indies, which receive electronic cigarette components, and where are least one of the compartment is an elongated compartment. The box also includes a battery compartment with a battery contact for engaging a replaceable battery, and a charge circuit coupled to receive power from the battery contact. A charge contact assembly is coupled to the charge circuit and aligned with the elongated compartment to engage the electrical coupling of an elongated component, which can then transfer power to its rechargeable power source. Also, a lid is selectively engaged with the access opening to close the box.

17 Claims, 5 Drawing Sheets

2

CHARGER PACKAGE FOR ELECTRONIC CIGARETTE COMPONENTS

BACKGROUND OF THE INVENTION

1. Field of the Invention

The present invention relates to electronic cigarettes. More specifically, the present invention relates to a battery charger and package for electronic cigarette components.

2. Description of the Related Art

Electronic cigarettes have become increasingly popular in recent years. Electronic cigarettes emulate tobacco cigarettes, but without the combustion of tobacco during use. Rather than burning tobacco, a fluid is atomized within the electronic cigarette, which emulates the smoke produced in a tobacco cigarette. The fluid may contain flavoring agents such as tobacco flavor, menthol, and others, to enhance the "smoking" experience of the electronic cigarette. Nicotine has been added to the atomization fluid in prior art electronic cigarettes. Since electronic cigarettes are not real cigarettes, they can be enjoyed in designated non-smoking areas, which are becoming increasingly common.

While tobacco cigarettes produce smoke through combustion of tobacco, electronic cigarettes produce atomized vapor using an atomizer. The atomizer consumes electric power, which is provided by a rechargeable power source within each electronic cigarette. Of course, the rechargeable power source is depleted during operation and must be recharged from time to time. It is know to use a power adapter to input power to recharge the electronic cigarette. Such power adapters are driven by a power supply, such as the familiar wall-plug transformer, or through an intermediary device that provides the transformer function. A problem with using power adapters is that they require access to an AC power main source for operation. In contrast, tobacco cigarettes are fully self-contained, requiring no AC power source. It is desirable to provide a similar degree of freedom with electronic cigarettes as well.

Tobacco cigarette users are familiar with carrying a pack of twenty cigarettes, which is commonly provided in the form of the flip-top cardboard box. These compact boxes are of a convenient size, which users have adapted to carry in a variety of familiar ways. Thus, it can be appreciated that electronic cigarettes system that might employ such similarly sized packages would correspond well to the tobacco cigarette experience. In fact, such packages exist and are used to carry various components of an electronic cigarette system. These components include elongated battery components, mouthpieces, atomizers, spare fluid and other items. It can be appreciated that such a package might also provide a power reserve, freeing the user from the need to access AC mains power for a greater length of time. Thus, it can be appreciated that there is a need in the art for an improved package for carrying electronic cigarettes and electronic cigarette components.

SUMMARY OF THE INVENTION

The need in the art is addressed by the apparatus of the present invention. The present invention teaches a charger package apparatus for use with electronic cigarette components, which include truncated components and elongated components that have an electrical coupling connected to a rechargeable power source. The apparatus includes a compact box enclosure with an access opening, and with plural compartments formed indies, which receive electronic cigarette components, and where are least one of the compartment is an elongated compartment. The box also includes a battery compartment with a battery contact for engaging a replaceable battery, and a charge circuit coupled to receive power from the battery contact. A charge contact assembly is coupled to the charge circuit and aligned with the elongated compartment to engage the electrical coupling of an elongated component, which can then transfer power to its rechargeable power source. Also, a lid is selectively engaged with the access opening to close the box.

In specific embodiment, the foregoing apparatus includes a hinge disposed between the box and the lid, which is selectively engaged to close and open the access opening. In a refinement to this embodiment, the box, the lid, and the hinge are sized and proportioned to closely resemble a conventional cardboard flip-top tobacco cigarette package.

In a specific embodiment of the foregoing apparatus, where the electronic cigarette components each have a predetermined length selected from a finite number of component lengths, including an elongated component length, the plural compartments are each configured with a depth selected from a finite number of compartment depths, which correspond to the finite number of component lengths. In a refinement to this embodiment, each of the plural compartments has a depth, selected from the finite number of compartment depths, which is shorter than the corresponding length of each electronic cigarette component, selected from the finite number of components lengths, such that a portion of the length of each electronic cigarette component extends out of the access opening, thereby facilitating manual access and grasping of the components. In a further refinement, the lid is configured with a recessed portion that covers and encloses the plural electronic cigarette components while the lid is selectively engaged to close the box.

In a specific embodiment of the foregoing apparatus, wherein the electronic cigarette components are cylindrical, the plural compartments are also cylindrical.

In a specific embodiment, the foregoing apparatus further includes a component retention member that is fixed to the box and is arranged to retain the electronic cigarette components in the plural compartments. In a refinement to this embodiment, the component retention member retains the electronic cigarette components with friction. In a further refinement, the component retention member is formed from a resilient polymeric material, such as silicone rubber. In another refinement, the component retention member is disposed about the access opening and comprises plural orifices corresponding to the plural compartments for receiving and retaining the electronic cigarette components. In another refinement, the apparatus further includes plural nibs disposed about the interior of the plural orifices on the retention member, which frictionally engaging the electronic cigarette components. In yet another refinement, each orifice located at an elongated compartment contains a greater number of nibs than those orifices located at a non-elongated compartment.

In a specific embodiment, the foregoing apparatus further includes an input terminal coupled to the charge circuit for receiving electric power from an external power source. In a refinement to this embodiment, the input terminal is a USB jack, and the charge circuit is adapted to extract electric power from an external USB compliant device.

In a specific embodiment, the foregoing apparatus further includes a battery level indicator coupled to the charge circuit. The battery level indicator may be an LCD bar graph type of display. In a refinement to this embodiment, the apparatus further includes an actuator coupled to the charge circuit, and operable to activate the battery level indicator. In another refinement, the apparatus further includes an illuminator coupled to the charge circuit that is activated upon actuation of the actuator.

In a specific embodiment of the foregoing apparatus, the charge contact assembly further includes a first electric contact that has a first spring to urge the first electric contact against the electric coupling of an elongated component when inserted into the elongated compartment. In a refinement to this embodiment, the charge contact assembly further includes a second electric contact that has a second spring to urge the second electric contact against the electric coupling of the elongated component when inserted into the elongated compartment. The first electric contact and the second electric contact may be positioned coaxially.

DESCRIPTION OF THE INVENTION

Figure 1B:
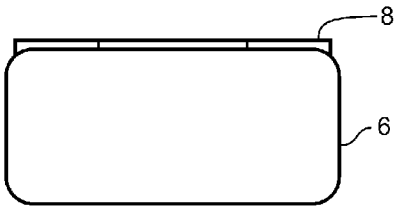
FIGS. 1A, 1B, 1C, 1D, and 1E are front view, top view, bottom view, side view and back view drawings, respectively, of an electronic cigarette battery charger package according to an illustrative embodiment of the present invention.
Figure 1A:
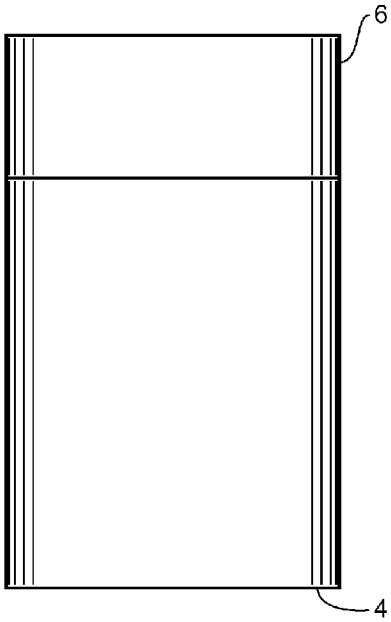
Figure 1D:
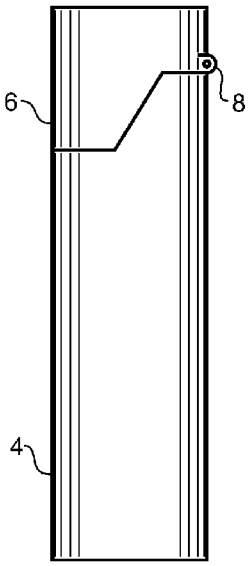

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed illustrative embodiments of the present invention, it will be observed that the present invention is presented primarily in combinations of various components arranged to form the illustrative embodiment apparatus and systems, or various steps to accomplish the illustrative methods. Accordingly, the apparatus and system components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The illustrative embodiments of the electronic cigarette charger package provide unique advantages for both storing the various electronic cigarette components and for managing power supply to the rechargeable power supplies in the elongated components typically employed to house them. In an illustrative embodiment, the charger package itself includes a replaceable lithium-ion rechargeable battery that provides a greater power reserve and can be used to simultaneously recharge plural of the rechargeable power supply components while they are conveniently stored in the charger package. Other components are also simultaneously stored such that the charge package provides a complete portable solution to the electronic cigarette user. Other illustrative embodiment features include the ability to store eight, or more, components in the same package. User convenience is enhanced through the user of an LCD battery reserve meter, a battery test actuator, and an illuminator so that these features are usable in any lighting condition. A unique component retention system use a silicone rubber membrane with plural apertures and gripping nibs to provide adequate retention friction while still providing easy user access. The illustrative embodiments also teach a unique spring-loaded electric contact system that ensures reliable power transfer from the internal lithium battery to the component power supply.

Figure 1E:
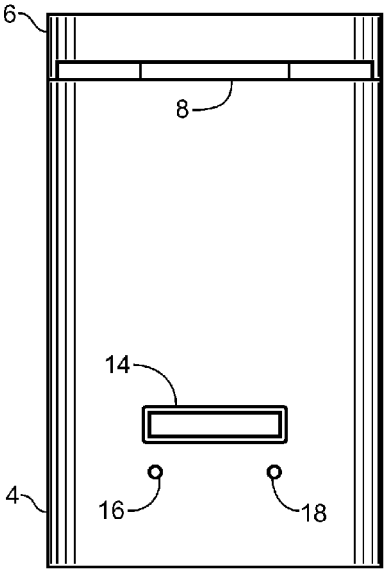
Figure 1C:
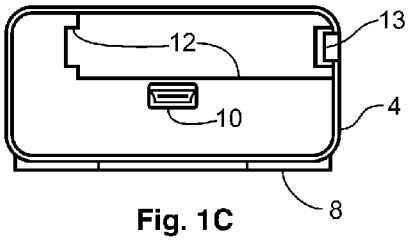

Reference is directed to FIGS. 1A, 1B, 1C, 1D, and 1E, which are front view, top view, bottom view, side view, and back view drawings, respectively, of an electronic cigarette battery charger package 2 according to an illustrative embodiment of the present invention. These drawing figures present a complete external view of the package 2, which is generally a compact enclosure having proportions of a scale similar to a conventional tobacco cigarette flip-top box. The package 2 consists of a box 4 and a lid 6 which can be selectively opened (not show in these drawings) to access the interior. A hinge 8 retains the lid 6 to the box 4 while both closed and opened. The bottom of the package 2 is illustrated in FIG. 1C. A battery compartment is closed by battery cover 12, which has a latch 13. An input terminal 10 is provided for connecting an external electric power supply. In the illustrative embodiment, a five pin "Mini-B" USB jack 10 is used as the external input terminal. This enables an internal charge circuit (not shown) to draw 5-volt DC power from any USB compliant device, such as a personal computer or USB power adapter, as are well known in the art. The back of the charger-package 2 is shown in FIG. 1E. An LCD display 14 presents a graphical representation of the battery reserve as a battery level indicator. An actuator 16 enables the user to selectively check the battery reserve. In addition, and LED illuminator 18 illuminates while the actuator 16 is actuated to further confirm operation of the charger package 2. The LCD display 14 is also illuminated by a back-light function while the actuator 16 is actuated.

Figure 2:
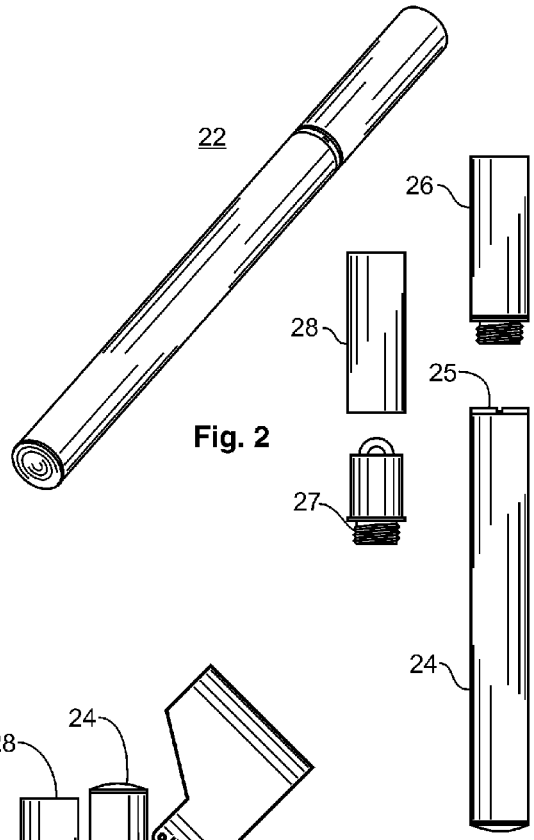
FIG. 2 is a drawing of an electronic cigarette and electronic cigarette components according to an illustrative embodiment of the present invention.

Reference is directed to FIG. 2, which is a drawing of an electronic cigarette 22 and certain electronic cigarette components according to an illustrative embodiment of the present invention. A perspective view drawing of an electronic cigarette 22 illustrates the similarity between it and a conventional tobacco cigarette. The illustrative embodiment electronic cigarette 22 is comprised of plural cylindrical components, which are also illustrated in FIG. 2. A first elongated component 24 incorporates a rechargeable power supply (not shown) and is terminated at one end with a combination mechanical coupler and electrical coupling 25, A mouthpiece assembly 26 is coupled to the first elongated component 24 to form a substantially complete electronic cigarette 22. The mouthpiece assembly 26 is further comprised of two components, an atomizer 27 and a mouthpiece 28. Thus, for this particular type of electronic cigarette 22, there are three individual component types, a first elongated component 24, a mouthpiece 28, and an atomizer 27. It is noteworthy that the combination mouthpiece assembly 26 is commonly stored in a package by the end user. Also, a cap (not shown) is typically inserted into the open end of a mouthpiece component 28 to preserve the freshness of an atomizing fluid stored therein, which also slightly increases its overall length. Thus, it can be appreciated that the various components have different lengths, even though they are all the same diameter. In general, there is the first elongated component 24 and the remaining components and assemblies are referred to as truncated components by virtue of their lengths relative to the elongated component.

Figure 3B:
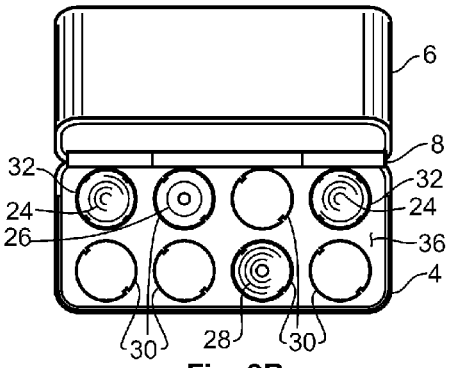
FIGS. 3A, 3B, and 3C are front view, top view, and side view drawings, respectively, of an electronic cigarette battery charger package according to an illustrative embodiment of the present invention.
Figure 3A:
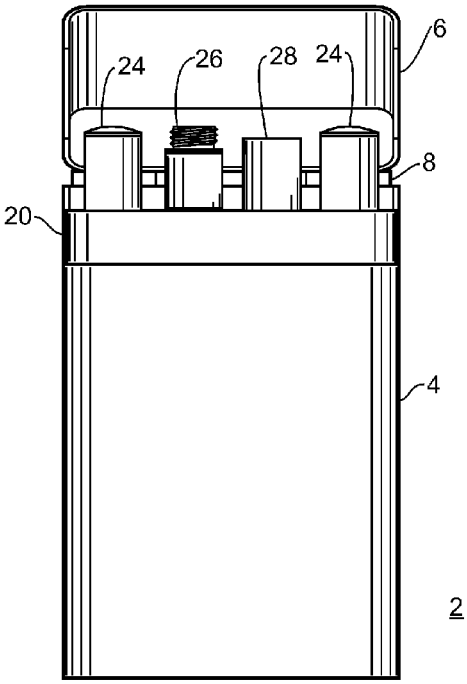
Figure 3C:
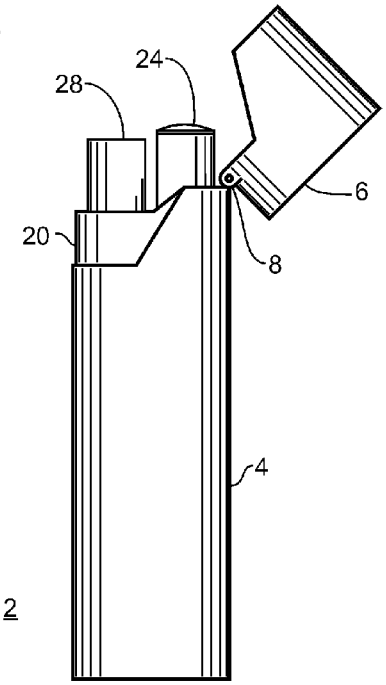

Reference is directed to FIGS. 3A, 3B, and 3C, which are front view, top view, and side view drawings, respectively, of an electronic cigarette battery charger package according to an illustrative embodiment of the present invention. These figures illustrate an electronic cigarette charger package 2, which is being utilized to contain plural electronic cigarette components, referred to hereinafter simply as "components". FIG. 3A is a front view of the box 4 with the lid 6 rotated about hinge 8 to an open position, enabling access to an access opening at the top of the box 4 into which the components are inserted and retained. Note that there is an overlapping portion 20 about the access opening of the box 4, such that a strong and tight arrangement is provided while the lid 6 is rotated to a closed position. In these figures, there are four components inserted into the charger package, a pair of elongated components 24, a mouthpiece assembly 26, and a mouthpiece 28. Each of these components extends above the access opening in the box 4 and above the overlapping portion 20, which enables manual access with the fingers of a user. Correspondingly, the lid 6 has a recessed portion that extends above the overlapping portion 20 of the box 4 such that the components are fully covered and enclosed between the box 4 and lid 6 which they are joined to the closed position.

FIG. 3B illustrates a top view of the charger package 2 showing the lid 6 in a open position with the plural components 24, 26, and 28 inserted into the access opening of the box 4. A retention member 36 is disposed within the box 4 and comprises plural apertures 30, 32. In the illustrative embodiment, there are eight total apertures, two of the type illustrated as item 32 and six are of the type illustrated as item 30. These will be more fully discussed hereinafter. The retention member serves the function of retaining the components in the box 4 with sufficient force to hold them in the desired place, and also to allow reasonable access for manual removal by the user. Apertures 32 are distinguished in that they serve to retain elongated components, which are urged against a charge contact assembly within the box, and thus require suitable performance to assure that electrical contact is reliably made. This aspect will also be more fully discussed hereinafter.

Figure 4B:
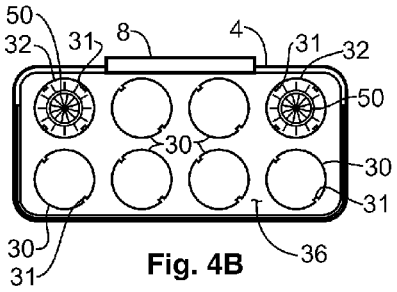
FIGS. 4A, 4B, 4C, 4D, and 4E are front view, top view, bottom view, side view and back view drawings, respectively, of an electronic cigarette battery charger package showing internal components according to an illustrative embodiment of the present invention.
Figure 4A:
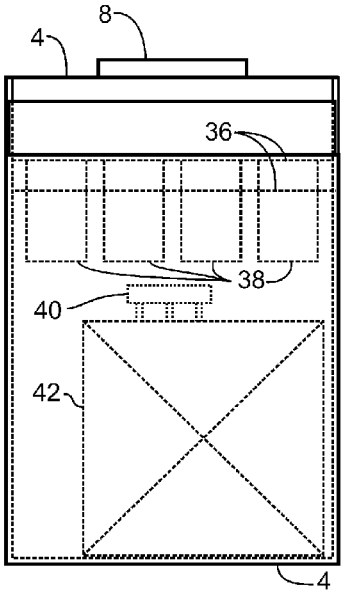
Figure 4D:
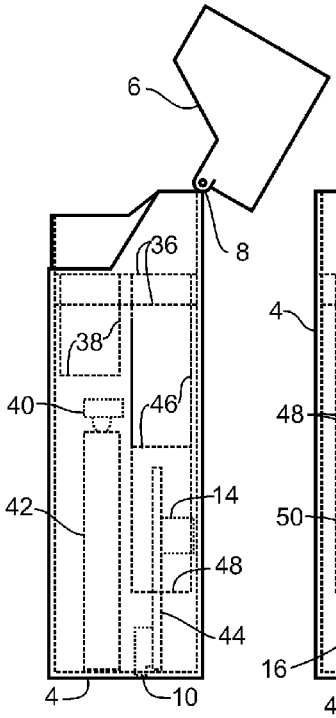
Figure 4E:
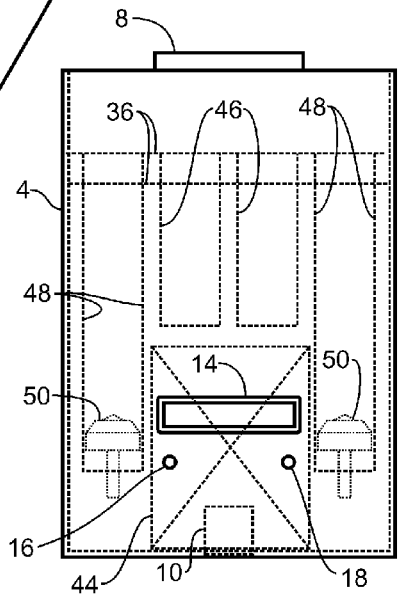
Figure 4C:
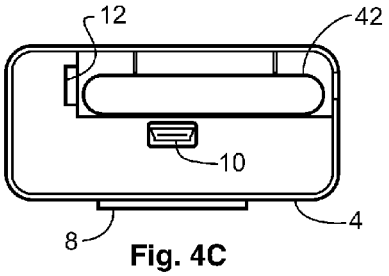

Reference is directed to FIGS. 4A, 4B, 4C, 4D, and 4E, which are front view, top view, bottom view, side view and back view drawings, respectively, of an electronic cigarette battery charger package showing internal components according to an illustrative embodiment of the present invention. FIG. 4A is a front view drawing of box 4 illustrating some of the internal components of the charger package. The retention member 36 is present, which is a silicone rubber membrane in the illustrative embodiment, having the plural apertures formed therethrough. Other suitable polymeric materials know to those skilled in the art can also be used. These apertures 30 align with plural compartments 38, which receive some of the truncated components. Note that the depth of the compartments 38 is selected such that the corresponding components, the aforementioned mouthpiece components, cannot be seated so deeply in the box 4 that they may be overly difficult to manually remove. The truncated compartments 38 also provide adequate space below to house the battery contacts 40 and battery 42 in the charger package. In the illustrative embodiment, a 720 mAh 4.2 volt lithium-ion replaceable battery is used. The bottom view drawing of FIG. 4C illustrates the location of the battery 42 in the battery opening 12. Also, the location of the input terminal, s Mini-B USB jack 10, is shown.

The top view drawing in FIG. 4B provides a clearer detail of the retention member 36 within the box 4. Note that there are six apertures 30 used to engage truncated components. These apertures 30 each have a pair of polymeric nibs 31 disposed on the interior of their annular surfaces. The nibs extent to an interference position with respect to the diameter of the components, thus assuring there will be a friction fit to retain the components in place. The quantity, size, and length of the nibs 31 is selected to provide the desired degree of retention. Now, with respect to the two apertures 32, these apertures each have three, or more nibs 31 about their interior annular surfaces. FIG. 4B shows four nibs and certain illustrative embodiments have six nibs. The greater number of nibs provides a greater degree of retention. This is useful since apertures 32 each support an elongated component that engages a charge contact assembly 50 located at the bottom of the corresponding compartment. The greater degree of retention assures a more reliable electrical connection.

Further, regarding the arrangement of the elongated component storage, consider FIG. 4E. This is a back view of the charger package box 4 showing the internal components. The retention member 36 is disposed above the elongated compartments 48 and two additional truncated compartments 46. A charge contact assembly 50 is disposed at the bottom of each of the two elongated compartments 48. Thus, when an elongated component is inserted into the elongated compartment 48, the charge contact assembly is engaged to transfer power. The aforementioned nibs 31 hold the various elements in proper alignment. In the illustrative embodiment, two elongated compartments are provided. However, in other embodiments, there may be a range of elongated compartments from one to eight. FIG. 4E also reveals the position of the charge circuit 44, the LCD battery level indicator 14, as well as the actuator 16, the LED illuminator 18, and the USB jack 10. FIG. 4D is a side view, and also illustrates the location of internal components. These include the retention member 36, the truncated compartments 38 and 46, the elongated compartment 48, the battery contact 40, the battery 42, the drive circuit 44, the input terminal 10, and the LCD battery meter 14.

Figure 5A:
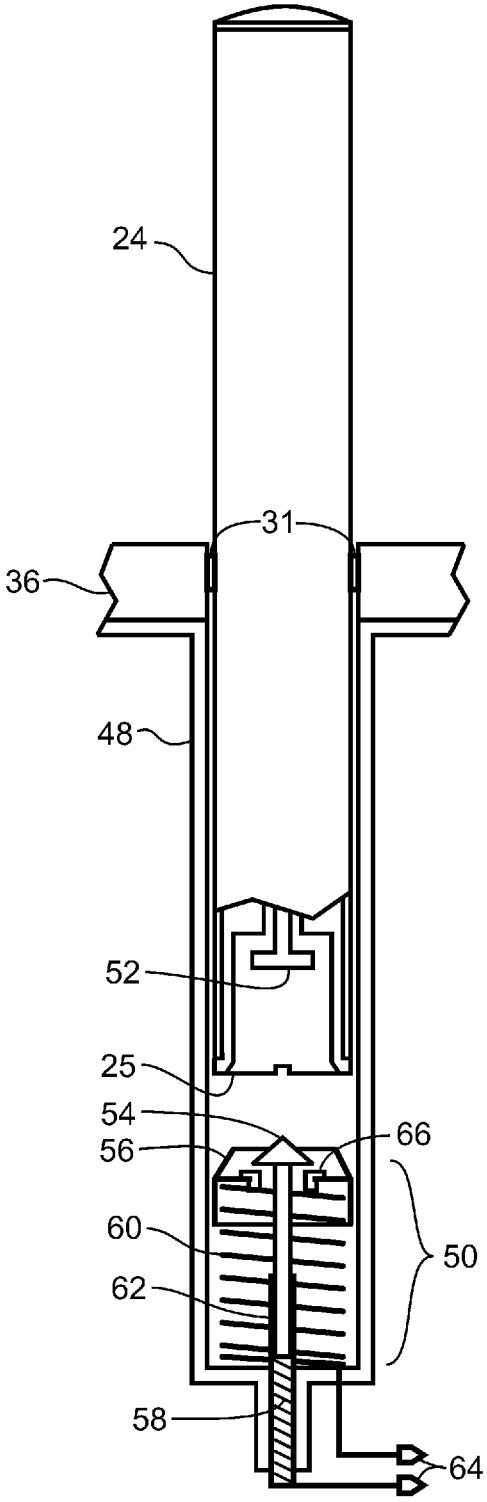
FIGS. 5A and 5B are detailed section view drawings of battery charging contacts in an electronic cigarette battery charger package according to an illustrative embodiment of the present invention.
Figure 5B:
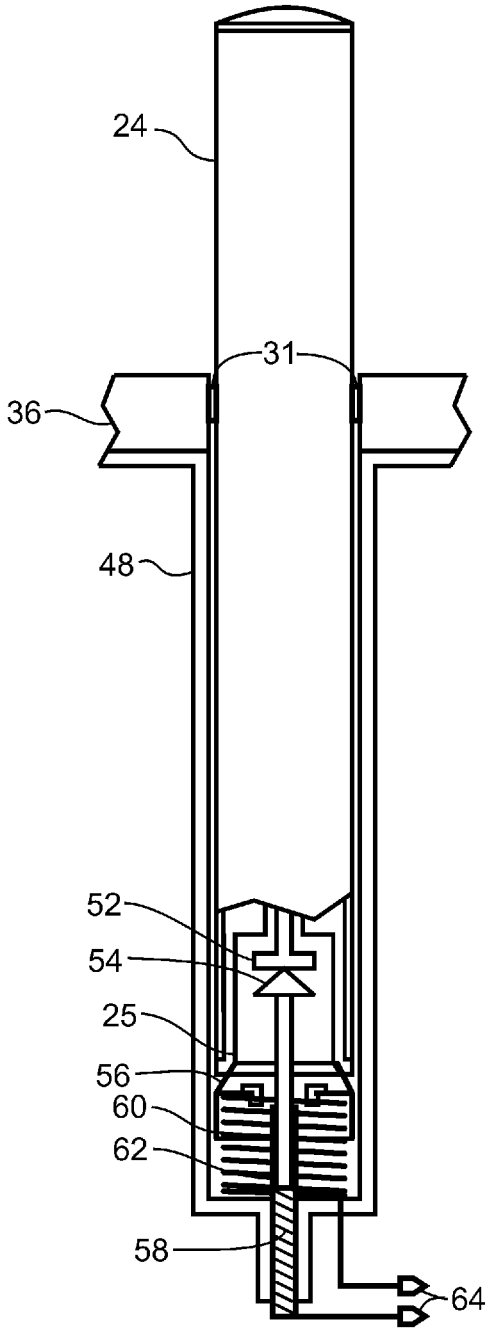

Reference is directed to FIGS. 5A and 5B, which are detailed section view drawings of the battery charging contacts 50 in an electronic cigarette battery charger package according to an illustrative embodiment of the present invention. FIG. 5A illustrates an elongated component 24 partially inserted into an elongated compartment 48, and FIG. 5B illustrates an elongated component 24 fully inserted into an elongated compartment 48. The aforementioned charge contact assembly 50 is located at the bottom of the elongated compartment 48. Note that the retention member 36 is located at the top of the elongated compartment 48, and that polymeric nibs 31 engage and locate the elongated component by force of friction. The coupler end 25 of the elongated component is an annular electrical coupling polarized with a first electrical polarity and a central electrical coupling 52 is polarized with a second electrical polarity. Thus, electric power can be coupled into the rechargeable power source inside the elongated component through these electrical couplings 25, 52. The charge contact assembly 50 is comprised of a center electrical contact 54 that is urged upwardly through guide stem 62 by spring 58. The guide stem 62 enables linear movement in an up and down direction, while maintaining electrical continuity with terminal 64. A second coaxial electric contact 56 is located about the first electrical contact 54, and is insulated from contact therewith by insulator 66. A second spring 60 urges the second coaxial electric contact 56 upwardly, and enables linear movement in an up and down direction, while the elongated compartment 48 serves as a guide.

Now, considering FIG. 5B, as the elongated component 24 is move downwardly, the annular electrical coupling 25 engages the second coaxial electric contact 56, making electrical contact and urging it downwardly. This movement continues until central electrical coupling 52 engages center electrical contact 54 and urges it slightly downward, as well as making electrical contact therewith. This action completes and electrical charging connection from terminals 62 to the rechargeable power source inside of elongated component 24. Note that nibs 31 retain the elongated component in electrical contact until manually removed by the user.

Figure 6:
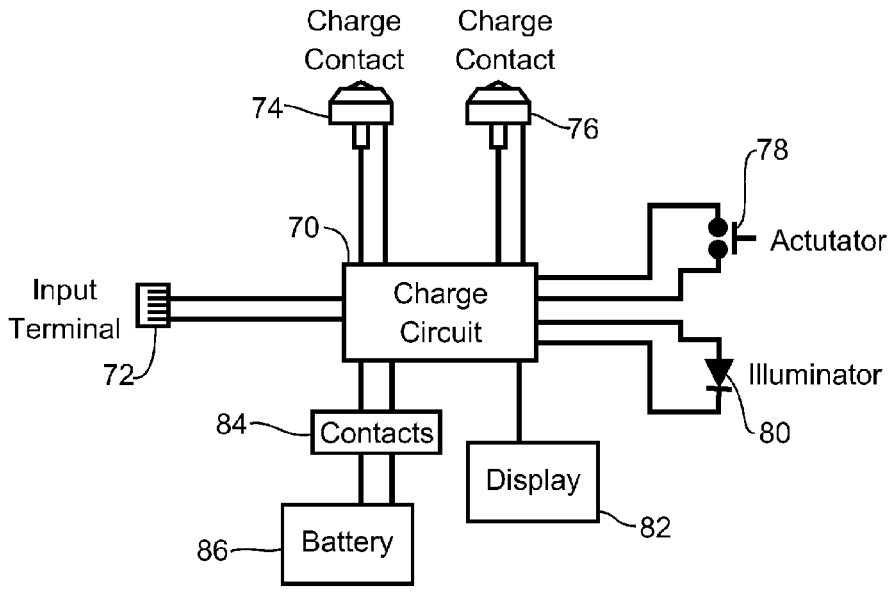
FIG. 6 is a functional block diagram of an electronic cigarette battery charger package according to an illustrative embodiment of the present invention.

Reference is directed to FIG. 6, which is a functional block diagram of an electronic cigarette battery charger package according to an illustrative embodiment of the present invention. A pair of charge contact assemblies 74, 76 are coupled to a charge circuit 70. The charge circuit 70 derives electric power from eight battery 86 through battery contact 84, or through input terminal 72. The charge circuit is operable to charge battery 86 from external power input to input terminal 72. The charge circuit 70 is further operable to charge rechargeable power sources electrically coupled to charge contact assemblies 74, 76. The circuit designs for such charge circuits are know to those skilled in the art. A manual actuator 78 is coupled as an input to the charge circuit 70. Upon actuation of the actuator 78, the charge circuit 70 is operable to measure the power reserve in battery 86 and output that information to display 82 for visual access by the user. An LCD bar graph display 82 is employed in the illustrative embodiment. And LED illuminator 80 is also coupled to the charge circuit 70. The illuminator 80 is illuminated upon actuation of the actuator 78.

Figure 7:
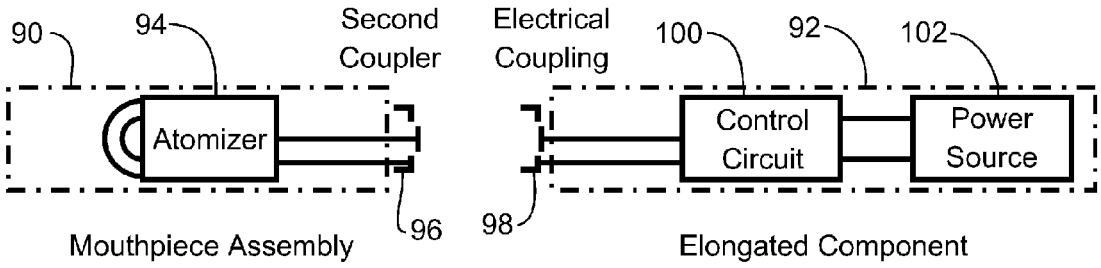
FIG. 7 is a functional block diagram an electronic cigarette according to an illustrative embodiment of the present invention.

Reference is directed to FIG. 7, which is a functional block diagram an electronic cigarette according to an illustrative embodiment of the present invention. The electronic cigarette is comprised of a mouthpiece assembly 90 having an atomizer 94 therein, and having a second coupler disposed thereon. The electronic cigarette is also comprised of an elongated component 92, which has a rechargeable power source 102 and a control circuit 100 therein. The rechargeable power source may be a rechargeable battery or a capacitor. And electrical coupling 98 is provided for connection to the mouthpiece assembly 90 and also for interface with the present invention charger package, which provides electric power to the control circuit 100 and the power source 102.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A charger package apparatus for use with electronic cigarette components, which include truncated components and elongated components that have an electrical coupling connected to a rechargeable power source, the apparatus comprising:

a box configured as a compact enclosure with an access opening, and having plural compartments formed therein for receiving the electronic cigarette components, said plural compartments consisting of at least a first elongated compartment;

a component retention member fixed to said box and arranged to retain the electronic cigarette components in said plural compartments, wherein said component retention member is disposed about said access opening and comprises plural orifices corresponding to said plural compartments for receiving and retaining the electronic cigarette components, and wherein at least a first nib is disposed on an interior annular surface of one of said plural orifices for frictionally engaging a cigarette component;

a battery compartment disposed within said box, having a battery contact for engaging a battery;

a charge circuit coupled to receive power from said battery contact;

a charge contact assembly coupled to said charge circuit and aligned with said elongated compartment to engage the electrical coupling of an elongated component thereby transferring power to its rechargeable power source while engaged in said elongated compartment, and a lid selectively engaged with said access opening to close said box.

2. The apparatus of claim 1, further comprising:

a hinge disposed between said box and said lid, thereby enabling selective engagement to close and open said access opening.

3. The apparatus if claim 2, and wherein:

said box, said lid, and said hinge are sized and proportioned to closely resemble a conventional cardboard flip-top tobacco cigarette package.

4. The apparatus of claim 1, and wherein the electronic cigarette components each have a predetermined length selected from a finite number of component lengths, including an elongated component length, and wherein:

said plural compartments are each configured with a depth selected from a finite number of compartment depths, which correspond to the finite number of component lengths.

5. The apparatus of claim 4, and wherein:

each of said plural compartments has a depth, selected from said finite number of compartment depths, which is shorter than the corresponding length of each electronic cigarette component, selected from the finite number of components lengths, such that a portion of the length of each electronic cigarette component extends out of said access opening, thereby facilitating manual access thereto.

6. The apparatus of claim 5, and wherein:

said lid is configured with a recessed portion that covers and encloses the plural electronic cigarette components while said lid is selectively engaged to close said box.

7. The apparatus of claim 1, wherein the electronic cigarette components are cylindrical, and wherein;

said plural compartments are cylindrical.

8. The apparatus of claim 1, and wherein:

said component retention member is formed from a resilient polymeric material.

9. The apparatus of claim 1, further comprising:

plural nibs disposed about said plural orifices on said retention member for frictionally engaging the electronic cigarette components.

10. The apparatus of claim 9, and wherein:

each orifice located at an elongated compartment contains a greater number of nibs than those orifices located at a non-elongated compartment.

11. The apparatus of claim 1, further comprising:

an input terminal coupled to said charge circuit for receiving electric power from an external power source.

12. The apparatus of claim 11, and wherein:

said input terminal is a USB jack, and said charge circuit is adapted to extract electric power from an external USB compliant device.

13. The apparatus of claim 1, further comprising:

a battery level indicator coupled to said charge circuit.

14. The apparatus of claim 13, further comprising:

an actuator coupled to said charge circuit, and operable to activate said battery level indicator.

15. The apparatus of claim 14, further comprising:

an illuminator coupled to said charge circuit that is activated upon actuation of said actuator.

16. The apparatus of claim 1, and wherein said charge contact assembly further comprises:

a first electric contact having a first spring to urge said first electric contact against the electric coupling of an elongated component when inserted into said elongated compartment.

17. The apparatus of claim 16, and wherein said charge contact assembly further comprises:

a second electric contact having a second spring to urge said second electric contact against the electric coupling of the elongated component when inserted into said elongated compartment, and wherein said first electric contact and said second electric contact are positioned coaxially.

* * * * *